United States Patent [19]

Beck et al.

[11] 4,274,362

[45] Jun. 23, 1981

[54] MAGNETIC BRUSH MIXING AUGERS

[75] Inventors: Christian A. Beck, Ridgefield; Walter J. Jurkowski, Fairfield; Charles E. Pegg, Danbury, all of Conn.

[73] Assignee: Pitney Bowes, Inc., Stamford, Conn.

[21] Appl. No.: 100,577

[22] Filed: Dec. 5, 1979

[51] Int. Cl.[3] ..... G03G 15/09

[52] U.S. Cl. ..... 118/657; 118/612; 355/3 DD; 366/297; 366/318

[58] Field of Search ..... 118/656, 657, 658, 612; 355/3 DD; 222/DIG. 1; 366/297, 318

[56] References Cited

U.S. PATENT DOCUMENTS

| | | | |
|---|---|---|---|
| 3,180,313 | 4/1965 | Eisner | 222/DIG. 1 |
| 3,233,586 | 2/1966 | Cranskens et al. | 118/657 X |
| 3,639,051 | 2/1972 | Charlap et al. | 355/3 DD |
| 3,943,886 | 3/1976 | Vola et al. | 118/657 |
| 3,998,537 | 12/1976 | Smith et al. | 355/3 DD |
| 4,146,323 | 3/1979 | Forward et al. | 366/324 X |

*Primary Examiner*—Philip R. Coe

*Attorney, Agent, or Firm*—Lawrence E. Sklar; William D. Soltow, Jr.; Albert W. Scribner

[57] ABSTRACT

Within the sump of a dry developing, magnetic brush system in an office copier machine, twisted strips of aluminum sheet metal are used to form an auger blade mixing arrangement for the purpose of mixing dual component developer. Each auger blade is formed from strip sheet metal into a single, elongated helical convolution and is appropriately journaled at each end for the application of rotative power. In addition, the auger blades have smooth, rounded, axial edges which provides extended useful life to the carrier constituent due to reduced shearing effects.

1 Claim, 3 Drawing Figures

MAGNETIC BRUSH MIXING AUGERS

BACKGROUND OF THE INVENTION

1. Field of the Invention

This application relates to an improvement in apparatus for mixing the ingredients of two component magnetic developer material used within the dry developing apparatus of a typical office copying machine. Mixing devices in various auger form are used for combining dry marking and ferromagnetic carrier constituents. Both developer components are mixed to form a specific dry developer formula composed of a predetermined ratio of marking to iron carrier constituents. The desired developer composition is best accomplished by mixing auger members arranged within the lowermost, sump portion of the dry developing apparatus. During the course of mixing, the auger mixer arrangement also contributes to providing the so-called triboelectric charging effect to the marker-carrier constituent, which enables image development.

There are provided in the dry developing apparatus two separate subsystems that provide major functions required in the operation of the developing unit. The primary portion of the developing system is comprised of various mechanical apparatus which is suspended within the pan-shaped enclosure comprising the basic developing unit framework. The pan is designed to minimize spillage of dry particulate material due to mixing, circulation and general operation. The developing unit pan also has appropriate journals located in the end frames intended to suspend various rotatably driven mixing, distribution, circulation, and developer application members.

The mixing auger members are located in the developing unit pan, usually in the sump portion, and are intended to circulate and distribute the carrier while also intermixing dry marker constituent into the carrier constituent. The marker or, as otherwise known in the xerographic art, toner, is regularly dumped into the vicinity where the mixing auger members revolve, by a toner dispensing system. The dispensing system comprises the second functional developing unit subsystem and has rotating apparatus included to dump the marker in a regular, evenly distributed amount while the copier machine is in operation.

During continuous cycles of operation of the copier machine, images are endlessly developed according to operator demand. The actual physical image development occurs continuously according to demand at the process station development zone. The developing apparatus, and more specifically, the magnetic applicator roller within the apparatus, continuously applies a predetermined amount of developer to the oncoming images, which are previously exposed upon a photoconductor member, by operating means associated with illumination and image translation arranged for the purposes of projecting the original document image.

The marker is carried to the development zone by the ferromagnetic carrier constituent, the virtues of which are well known in the xerographic art. Within the applicator roller, one of numerous magnets cause the ferromagnetic carrier particles to bristle radially outward from the applicator roller surface. In so doing, the bristle, or brush, engages the photoconductor image carrier surface and the electric differential in charge potential between exposed latent image and charged marker particle constituent renders a physical marker transfer and attachment to the exposed latent photoconductor image, thereby causing the visual image development on the photoconductor. In this manner and from this position, the visual marked image is carried on the photoconductor to a transfer station, also part of the overall copier process, where the image is then caused under influence of electrical potential to physically migrate to a piece of copy paper. The resulting transposed image copy is then directed through a fusing station which permanently fixes the image to the copy sheet.

The developing process continues upon repeated cyclic operation of the copier machine, as required by the machine operator. Due to repeated endless operation, there is, however, a concern regarding abrasive wear of the ferromagnetic marker-carrier constituent. The carrier constituent is endlessly recycled within the developing apparatus in order to reaccumulate a fresh supply of marker after deposition at the development zone in the course of image development. Recycling the carrier constituent is provided through developing unit apparatus which rotatively mixes, circulates, and causes a general stream-like flow of carrier with attached marker to the development zone. In one portion of the cycle, the carrier constituent is empty, or relieved of marker, and is caused to slide down an inclined ramp to the mixing zone admidst revolving augers.

During the course of the endless cyclic motion that the carrier is subjected to, there is of course a great deal of abrasive rubbing of carrier particles on the developing unit pan and against revolving elements which impart the flow of developer. This rubbing and abrasive action eventually wears the fiber-like carrier particles until they become smaller in size, having been worn down in effect to a rounded shape. The abrasion, reduced size, and rounded shape all combine to reduce the effectiveness of the carrier.

The initial stages of developer preparation begins at the mixing auger station in the developing unit sump where the two separate developer constituents are mixed together by a combined radial and axial tumbling action. From this point, and in pursuit of gathering a constant flow of mixed developer, a rotating magnetic applicator roller attracts developer from the nearest revolving mixing auger. The developer is pulled across the sump pan floor by the magnetic applicator roller and attaches to the roller's outer cylindrical surface in a bristle-like form.

While remaining attached to the rotating applicator roller, the developer is then pushed against a narrow aperture arranged to engage the bristled developer. The aperture acts as a doctoring device and restricts or limits to a desired amount the developer to be applied at the development zone. During further rotation of the applicator roller, the developer in bristle form stands radially outward from the roller and engages the photoconductor member, usually arranged to move in an opposing relative direction with respect to the applicator roller.

Of course, the carrier constituent is relieved of marker at the development zone due to the marker development transfer process, but carrier remains attached to the magnetic applicator roller until it rotatably travels attached to the magnetic roller to the developing apparatus carrier stripper bar. At the carrier stripper bar, which is a fixed, non-moving blade-like member, arranged in close proximity to the applicator roller, the carrier is physically sheared off the roller. Finally, the detached carrier then slides down an inclined ramp under the influence of gravity to the point of origination admidst the rotating mixing auger members.

Within the developing apparatus mixing auger station, a fresh supply of marker is re-accumulated by the iron carrier constituent in order to provide the development system with an endless flow of developer at the development zone. The marker is also supplied endlessly in separate predetermined amounts by the toner dispensing apparatus. This marker dispensing apparatus is intentionally arranged within the developing apparatus so that it dumps marker directly between the revolving mixing auger members arranged beneath the dispenser apparatus.

2. Prior Art

U.S. Pat. No. 4,146,323 discloses the use of augering means within a developing apparatus to facilitate active crossmixing of the developer material. In particular, this patent discusses the need for active crossmixing of developer material, while the patent also provides a means of exemplifying the developer mixing process through the use of twisted, elongated auger blades having spaced slots along the helical edges of the auger blades.

U.S. Pat. No. 3,333,566 also describes an auger mixing means for a developing unit. Therein, the Inventor describes the use of simple strips of metal, twisted into auger shape and driven by meshing gears.

Accordingly, this present invention is aimed at a further improvement in the use of auger blade mixing devices for developing apparatus systems used within office copiers, the improvement being aimed at the extension of useful ferromagnetic carrier life through specific improvements in auger blade geometry.

SUMMARY OF THE INVENTION

The present invention finds applicability in the typical office copier machine which utilizes two component developer material, composed of a ferromagnetic carrier constituent in particulate form, and an appropriate marker constituent which is capable of assuming a triboelectric positive charge potential.

The invention is comprised of specific geometric improvements in the shape and construction of developer mixing auger members. Specifically, we have found that by providing rounded, arcuate axial edges on the mixing member, in combination with a limited amount of axial convolutions, there is reduced wear upon the ferromagnetic carrier constituent, and in turn, extension of useful carrier life.

OBJECTS OF THE INVENTION

It is a primary object of this invention to provide an improved auger blade mixing apparatus through the use of arcuate axial edges on the blade members in order to reduce shear and wear on ferromagnetic particulate carrier.

Another object is to provide a mixer-auger arrangement that provides minimal lateral thrust on the developer materials while providing the capability of maximum radial tumbling action.

DETAILED DESCRIPTION OF THE PREFERRED EMBODIMENT

Figures 1, 2:
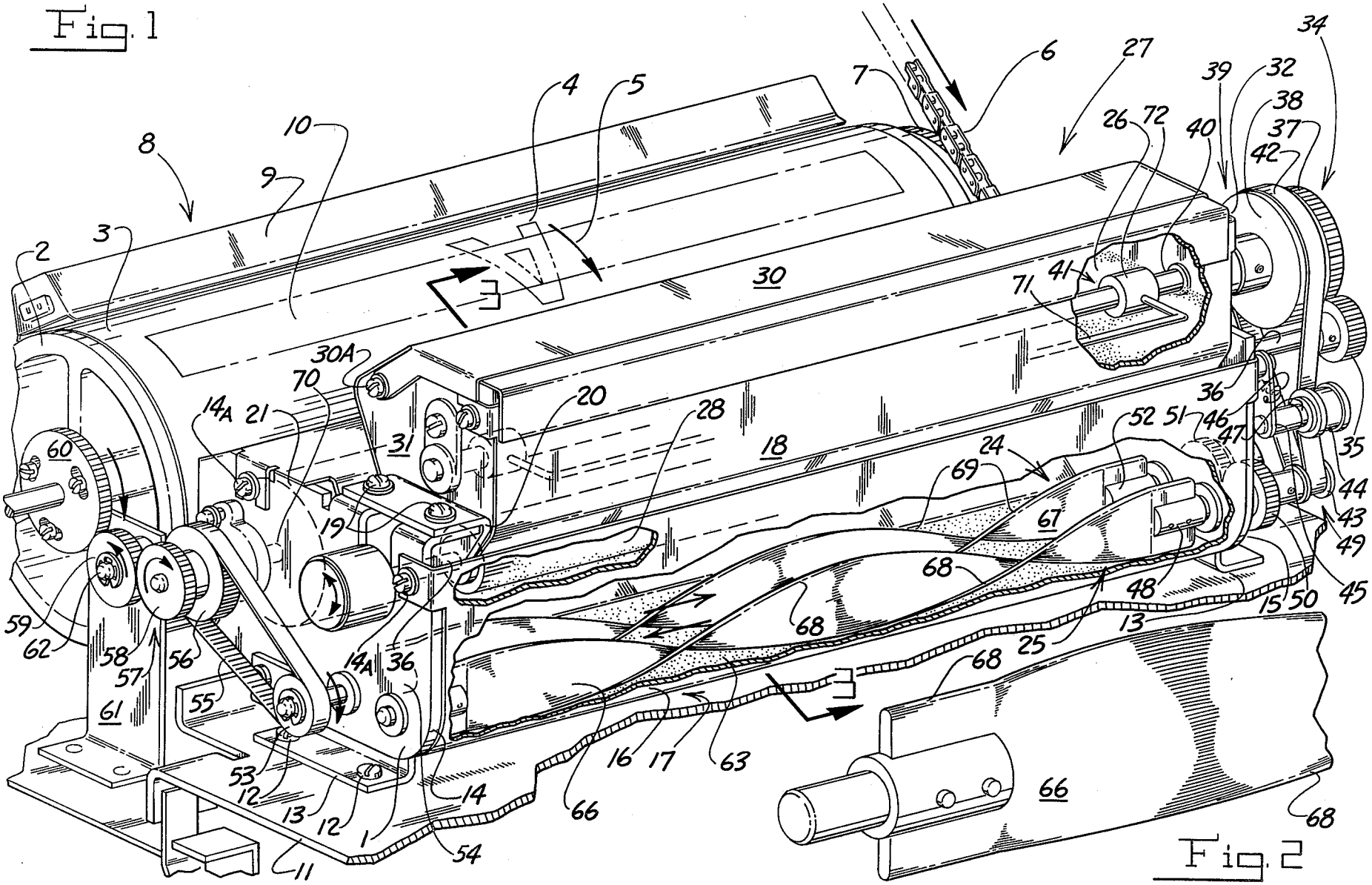
FIG. 1 represents an illustrative isometric sectional view of the developing apparatus and adjacent photoconductor drum apparatus.
FIG. 2 is a magnified view showing a partial section of one auger blade apparatus.

While referring to the accompanying drawings, we see in FIG. 1 an isometric sectional view of a developing unit 1 along with an adjacent photoconductor support drum 2. It is understood that FIG. 1 represents an internal portion of an office copier machine employing an electrophotostatic process. It will also be understood that the photoconductor support drum 2 is suitably mounted for rotation within the internal frame work of the copier machine.

Also shown in FIG. 1, a photoconductor member 2 is shown disposed on the circumference of drum 2. For the purposes of explanation, an undeveloped image 4 is shown residing upon the photoconductor surface 3. Image 4 represents a graphic illustration of how an optically translated image would appear on a photoconductor having been exposed at an object source and appropriately projected through the optical workings of the copier machine. In addition, for the purposes of illustrating a sense of motion, an arrow 5 depicts the direction of rotation of the drum 2 apparatus, as the drum is disposed admidst surrounding related image processing apparatus associated with the copier.

The aforementioned drum 2 is supported at its axis in suitable copier frame journal bearings and it will be understood by those skilled in the art that the drum 2 is capable of supporting an alternate shaped photoconductor 3 in web form. Of course, a wet style photoconductor would have additional support and tensioning means to enable rotation under frictional influence of associated rotating drive members.

In the present invention, an arrangement for rotatably driving the photoconductor support drum 2 is provided by drive chain member 6. Chain 6 is connectively engaged with chain sprocket 7, and also to a pinion sprocket mounted on the output shaft of a principle AC motor which provides the main rotative power for the copier machine.

Overlying the rotating photoconductor drum, there is also provided an optical arrangement which projects an illuminated object image onto the photoconductor 3, in space associated with space 10*a*. And, as previously mentioned, an exposed latent image 4 represents a latent image which, in the proceeding course of events, will be developed by the developing system described herein. In order for images such as the example cited to be exposed on a photoconductor image receiving member, a charging corona apparatus such as corona assembly 8 is suitably arranged in the copier structure surrounding the photoconductor drum. The corona shell 9 is intentionally positioned on the drum perimeter in close peripheral location with respect to the image receiving zone 10. Reasons for doing so include the necessity to maintain a corona imposed charge potential on the photoconductor at a high electrical potential level otherwise affected by copier process speed/time relationships.

Best seen in FIG. 1, immediately adjacent to drum 2 in a relatively horizontal plane, developing apparatus is secured to an internal structural copier frame bracket 11. Screws 12, typically secure the entire developing apparatus 1 to bracket 11 at the junction of the bent angular foot brackets 13 and supportive structural bracket 11. Within the structure comprising developing unit 1, the lateral angular brackets 13 are integrally welded to each separate developing unit end plate 14 and 15. Further appropriate attachment screws 14 provide means for holding the developing sump pan 16 and structural end frames 14 and 15. The net end result provides a rigid box-like container capable of handling and holding particulate developer material.

It will be recognized that the developing apparatus 1 described herein is comprised of two individual major subcomponents. There is a principle pan-like structure 17 which constitutes the major structural foundation of the developing apparatus, which holds developer material, and all driven rotating devices associated with mixing, circulating and feeding the developer 63. Directly secured to developing structure 17, a marker dispensing apparatus 18 is appropriately located to operate in conjunction with the workings enclosed in structure 17. An arrangement of angular brackets 20 are welded integrally with end frames 31 and 32 of the dispensing apparatus 18. This arrangement provides a mutual mounting means in conjunction with screws 19, brackets 20 and the flanged portions of the developing structure 17, and lateral end frames 14 and 15. The end result is that the developing unit 1 is a integral, structurally rigid assembly which is acceptable for supporting various internal functional driven members, and all respective rotative power applying means to be described in the following text. Also, it will be recognized that the structure thus described allows free rotation in appropriate bearing journals located in the respective lateral end frames for those functional driven members.

Figure 3:
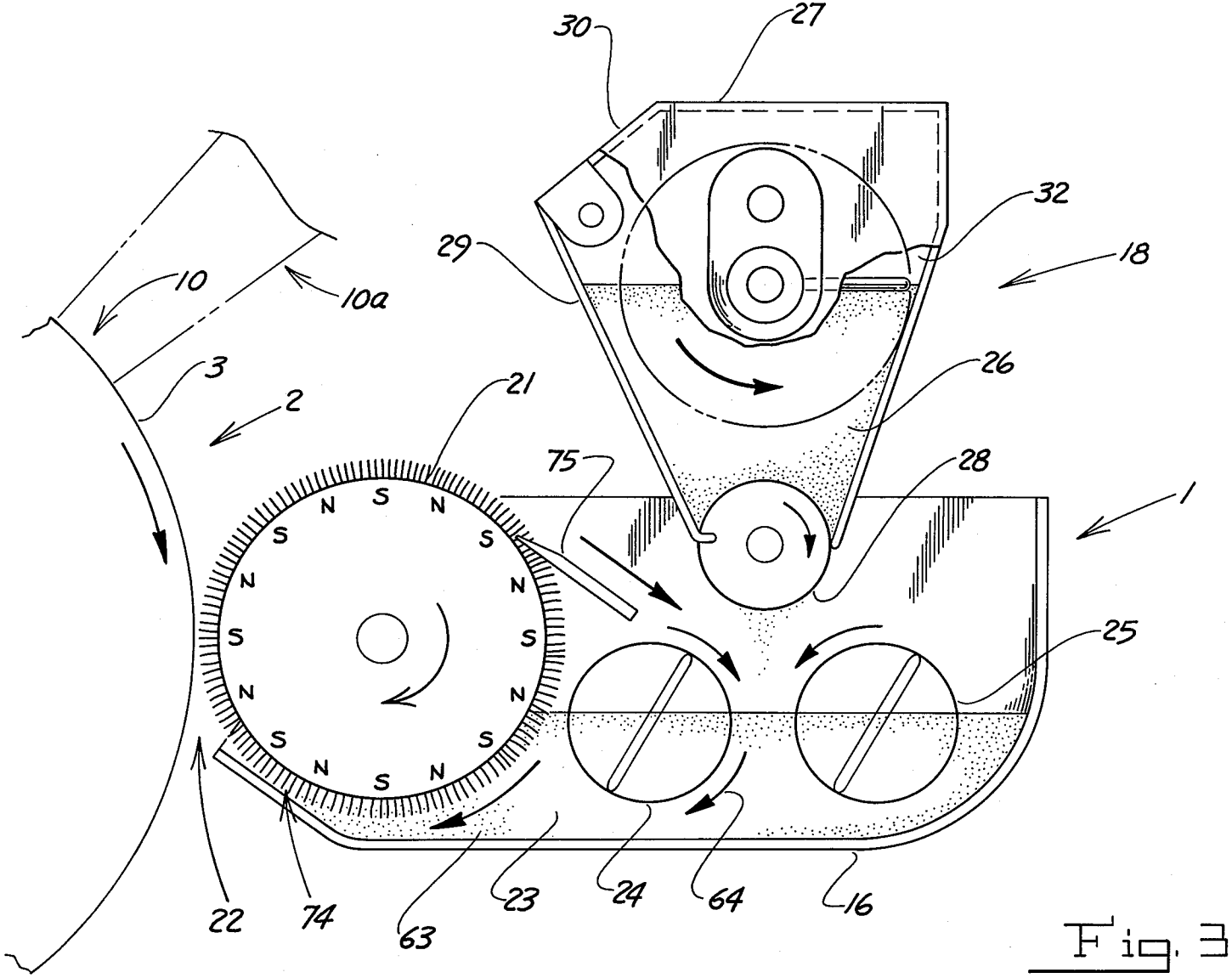
FIG. 3 is another view showing a cross section of the developing unit, through the distribution and circulation components of the dispensing and developing apparatus.

While referring to FIG. 3, it will be seen that the magnetic applicator roller 21 has been located in relative horizontal relationship to developing zone 22, and photoconductor support drum 2. The developing zone 22 is a relatively narrow, confined area, when viewed with respect to the rotating photoconductor drum apparatus 2. The arrangement of all components in the development area is provided to utilize space as efficiently as possible, and especially to provide a specific zone for contact with prepared developer.

In the development zone 22, it is necessary to provide the developer 63 in a continuous flow, and to accomplish this, the separate developer components must be mixed together and continuously stream fed to the development zone 22. Accordingly, the fiber-like ferromagnetic component 23 is held inside the developer sump pan 16, so that it is rotatably and axially circulated by mixing auger apparatus 24 and 25. Generally it can be seen in FIG. 3 that the auger apparatus 24 and 25, along with magnetic applicator roller 21 are all arranged to specific geometric advantage with respect to mixing, circulating and conveyance of developer material 63.

It is necessary of course to separately add marker constituent 26 to the ferromagnetic component 23. To this end, marker constituent 26 is supplied through means associated with dispensing apparatus 18. In fact, the dispensing apparatus 18 is functionally positioned directly over the mixing auger apparatus 24 and 25 with the intent to deposit marker 26 into the mainstream of the developer processing system. Accordingly, dispensing roller apparatus 28 is rotatably driven at an appropriate speed which allows a continuous minute flow of marker 26 to drop between revolving augers 24 and 25.

For the purposes of mixing marker 26 into the iron carrier constituent 23 a marker reservoir associated with the dispensing apparatus 18, is routinely filled by the copier key operator. Marker 26, is added fresh in substantial amount from an external source to the dispensing apparatus supply hopper 29. An appropriate, operator held supply container such as a bottle is used to fill the hopper 29 while the key operator gains access to the hopper 29 by physically raising a hopper cover lid 30. Lid 30 is conveniently located for operator access, being pivotally mounted on supporting screws **30*a* to the opposing lateral end frames 31 and 32 of the dispensing apparatus 18**.

Again referring to FIG. 3, the dispensing roller apparatus 28 is arranged to be located at the bottommost portion of hopper 29. This enables complete surface contact of marker 26 with roller 28 through all remaining levels of toner supply left in the hopper 29.

It will be recognized by those skilled in the art that the copier operator would immediately notice a change in output copy image quality when the marker supply is depleted. Indeed, the output copy image appearance will change from a degree of desired image darkness to virtually a light greyish appearance without a change in illumination level control, whereupon the copier key operator would add marker 26 to the supply hopper 29 as previously described.

Now, referring back to FIG. 1, rotative drive means for marker dispensing roller 28 is provided through input power supplied through all connective drive means to gear train 34. Also, gear 35 is suitably attached to dispensing roller apparatus 28 at roller shaft 36. Further, gear 37 and timing pulley 38 are unitarily molded together to form an integral part 39, so that gear 37 meshes with driven gear 35 while member 39 is suitably attached to agitation shaft member 40. Accordingly, the agitator shaft apparatus 41 is rotatably supported in appropriate bearing journals pressed into the lateral end plates 31 and 32 of dispensing apparatus 18. Rotative input power is supplied to agitator apparatus 41 through timing belt 42 and connective means associated with timing pulley 43. In order to provide proper belt 42 tension, idler pulley 44 is rotatably mounted on stud 47 which in turn is attached to pivot arm 45. Belt tension is thus provided through bias spring 46 being engaged to arm 45 which is pivotably mounted to the developing apparatus frame 15.

Rotative input power is transmitted to belt 42 through connective means associated with timing pulley 43. Pulley 43 is part of an integrally molded plastic part 49 which is suitably secured to auger member end journal 48, while the gear portion 50 of drive component 49 is further engaged with gear 51. Also, gear 51 is appropriately secured to end journal 52 which is that part of auger apparatus 24, adaptable to a bearing journal support. The final result further comprising a rigidly constructed auger apparatus through assembly means associated with rivets mechanically applied to the auger blade member 67.

In the interests of providing a compact physical arrangement, rotative input power for mixing auger apparatus 24 is provided through additional timing belt and meshing gear means located at an opposing lateral end of the developer unit 1, and opposite to the belt member 42 and associated drive means previously described. Accordingly, timing pulley 53 is suitably fastened to end journal 54 of auger apparatus 24. It will also be recognized by those skilled in the art that auger apparatus 24 and 25 are constructed with appropriate end journals, suitable and necessary to engage journal support bearings located in the opposing lateral end frames 14 and 15 of developing unit 1. Also, it will be recognized that auger apparatus 24 and 25 are each separately constructed of three separate pieces, namely two opposing lateral end journals, and the twisted helical auger blade member. Rivets appropriately fasten the auger components together in a concentric, and rigidly constructed manner, suitable for withstanding starting and running torque imposed by input rotative power means. Auger apparatus 24 is thereby powered by connective means associated with attached timing pulley 53 and connective timing belt 55 being further supported and driven by input timing pulley 56.

At this point, it will therefore be seen that mixing auger apparatus 24 and 25 and also dispensing roller apparatus 28 are all rotatably powered by the driven components thus described. Especially from input power supplied from timing belt 55, which is part of the associated main power transmission source. In this sense, belt 55 is connectively engaged to a unitary plastic molded drive component 57, comprised of pulley 56 and gear 58. Further, drive component 57 is suitably attached to the end journal 70 of the magnetic applicator roller apparatus 21. The gear portion 58 of drive component 57 meshes with idler gear 59 in order to transmit rotative power from a mating gear 60 which is suitably attached to a lateral end of drum 2. For the purpose of providing structural support for idler gear 59, a standing, flanged bracket 61 is suitably secured to the floor of the copier structure, while mounting stud 62 permits free rotation of gear 59.

Of course, it will be further recognized at this point, that drum 2 is comprised of a cylinder, suitable end caps, and attached drive components in order to permit rotational translation of input power torque through itself to the connecting drive components previously described herein. Thus, the main copier AC motor delivers input transmission power through chain 6, sprocket 7, drum 2 and all associated connective elements.

At this time, referring back to FIG. 3, it is important to discuss the merits and functions of certain respective components within developing unit 1. Especially, benefits provided by auger apparatus 24 and 25, in the interest of capturing the spirit of the invention at hand. Also, in the course of developing this invention, we have found that there are specific beneficial angular speed relationships between the flow of developer 63 material and the accompanying dispensing, mixing and circulation apparatus. For instance, the magnetic applicator roller 21 has best been found to carry a continuous usable flow of mixed developer 63 to the development zone 22, while rotating at 128 RPM. Specifically, magnetic roller 21 attracts mixed developer 63 material, while the developer 63 is being circulated by auger apparatus 24 and 25. This attraction is primarily directed at auger apparatus 24 since that particular auger is disposed immediately adjacent to applicator roll 21. Thus, developer 63 is pushed by auger 24 and attracted by magnetic roller 21, illustrated in FIG. 3 by arrow 64.

It is absolutely essential to maintain an effective supply of appropriately charged marker 26 for application at the development zone 22, in order to assure continuous optimum copy quality. Part of the continual process of providing this stream of prepared marker constituent 26 requires initially supplying the marker 26 to the magnetic carrier 23 in order to provide an opportunity to properly mix the marker 26 to carrier 23 to a predetermined ratio in order to form developer 63. Accordingly, marker 26 is dispensed into the general area between auger apparatus 24 and 25 with the intent of supplying marker 26 in an effective physical location or position with respect to the auger mixing apparatus 24 and 25. While the augers 24 and 25 cause the iron carrier constituent 23 to circulate radially and axially, marker 26 clings to fiber-like particles of carrier constituent 23 and thereby assumes a triboelectric charge due to the mixing action inflicted by the rotating auger member apparatus 24 and 25. During the course of the actual mixing of marker 26 into carrier 23, it has been found that a relative auger speed of 80 RPM maintains an adequate supply of developer 63 for the applicator roller 21. And, to supply a continuous flow of marker 26, the dispensing roller apparatus 28 is driven at a relative speed of 1.5 RPM. The speed combination thus described between marker dispensing means, mixing means and applicating means provides an effective developer 63 mixture for image development at zone 22.

Of course, the relative flow speeds of developer 63 material are important to the end of maintaining consistent image development, and the final hard output copy supplied to the demanding machine operator. The primary reason for success for this invention lies in the geometry defined by each auger blade member in combination, and as described herein.

In detail, we refer to FIG. 2 where one end of auger blade apparatus 25 is shown in a partial isometric view. Closer examination of this particular auger blade apparatus reveals that the blade 66 portion of the auger member is formed in such a manner so as to be twisted into a singular, axial, left hand convolution. The helical blade convolution is formed from material such as aluminum metal strips having arcuate edges 68. Auger blade member 67 is similarly formed in shape, and in respect to each other, auger apparatus 24 and 25 only differ where the respective end journal attachments are physically different in length or diameter in order to adapt to the associated drive components previously described.

Further detailed examination of the merits of the physical aspects of the auger blades 66 and 67 disclose that the arcuate edge portions 68 and 69 of the respective auger blades, are significant with respect to the handling of developer 63. In fact, those rounded edges have been demonstrated not to shear or otherwise mutilate the fiber-like iron particles comprising the carrier 23. Unlike the aforementioned prior art where augering blades have been constructed from metal strips having mechanically sheared edges, the rounded auger edges 68 and 69 herein described handle the developer 63 effectively for the purposes of mixing and charging marker 26, with further improvement in the overall life of the carrier 23 due to reduced shearing effect. It will also be recognized that the present invented auger blades 66 and 67, being formed into singular axial helical convolutions, provide minimal lateral push to the developer material and more emphasis on radial motion of the mixing function, nonetheless circulating both developer constituents for effect and to provide the required specific formula comprised of marker and carrier constituent 26 and 23.

Accordingly, the relative motion of developer 63 under, between and over the driven auger apparatus 24 and 25 provide an end result comprising a developer 63, which is applicable for continuous image development. Further, the net gain in extended operable life for the iron carrier constituent 23 more than offsets any subsequent increased manufacturing cost associated with fabricating the details of axial edge construction of the auger blade members 66 and 67 or the entire respective final auger blade apparatus 24 and 25. There is also an increased convenience to the key operator of the copier machine employing this improvement in auger construction through reduced requirement for replacing iron carrier due to increased carrier constituent longevity.

In the course of events required in the copier process, the developer 63 mixed by augers 24 and 25 is carried forward in stream-like form to the development zone 22 by the magnetic applicator roller 21, just after being doctored at zone 74, and just prior to application at zone 22 where the imposed latent image is continuously developed upon operation of the copier. And, in the course of continuous developing function, the iron carrier constituent 23 is relieved of its load of marker 26 at development zone 22 and the carrier is then rotatably carried to a stripper blade 75 shown in FIG. 3 whereupon the carrier is caused to separate from roller 21. Appropriately, carrier 23 then slides down the surface of stripper 75 in such a manner as to intercept the freshly dispensed supply of marker 26 being deposited between auger blade apparatus 24 and 25. In fact, the developer mixing process begins at this point and is enhanced by the mixer auger blade member geometry, relationship, construction and relative angular speeds described heretofor.

Referring to FIG. 1 once again, one additional functional aspect to developer unit 1 is found in the workings associated with agitator shaft apparatus 41. Agitator shaft apparatus 41 is continuously rotatably driven by the previously described power transmission components which provide power to component 39. The agitator shaft apparatus, being suitably attached to drive component 39 is rotatably driven at a relative angular speed of 18 RPM. A bent rod 71 is appropriately fastened to collar 72 at opposing lateral ends of dispensing apparatus 27 and connectively fastened to agitator shaft 40. Appropriately enough, the revolving marker agitator shaft apparatus 41 provides means for breaking up those inadvertant clumps of marker 26 which may result from adverse environmental conditions the copier is caused to operate within, or subjected to. In the interests of reliability, a consistent lump-free supply of marker is thereby provided to the developer processing system 1.

In conclusion, while the benefits of the auger blade member geometry and construction defined herein has been vigorously defined in a particular specific way it will be understood by those skilled in the art that further minor changes will only further enhance the invention at hand. Needless to say, the result of which will be the substantial improvement in iron carrier life expectancy. Therefore, the spirit and scope of the invention herein is further captured in the following claims.

What is claimed is:

1. In a developing apparatus for use in an electrostatic copying machine, the developing apparatus having a sump for holding two-component developing material consisting of a marking constituent and a magnetic carrier constituent, a magnetic applicator means rotatably mounted in the sump for withdrawing developing material from the sump and conveying it past a photoconductive member having an electrostatic image therein so as to deposit a quantity of the marking constituent on the electrostatic image to render it visible, an elongate mixing member having opposed flat surfaces rotatably mounted in the sump for continuously mixing together the marking and carrier constituents of the developing material, the mixing member being formed from an elongate strip of rigid material which is twisted to form a helix, and means for rotating the mixing member, the improvement comprising said mixing member having (a) a helical configuration which comprises said mixing member being twisted between its end so as to have one convolution therebetween and (b) an axial edge configuration which comprises an arcuate surface portion extending between the opposed flat surfaces of said mixing member.

* * * * *